US009033378B2

(12) United States Patent
Jenkins

(10) Patent No.: US 9,033,378 B2
(45) Date of Patent: May 19, 2015

(54) SECURITY DOOR LOCK DEVICE

(71) Applicant: Heath O'Brien Jenkins, Flowood, MS (US)

(72) Inventor: Heath O'Brien Jenkins, Flowood, MS (US)

( * ) Notice: Subject to any disclaimer, the term of this patent is extended or adjusted under 35 U.S.C. 154(b) by 317 days.

(21) Appl. No.: 13/694,125

(22) Filed: Oct. 31, 2012

(65) Prior Publication Data

US 2014/0117681 A1 May 1, 2014

Related U.S. Application Data

(60) Provisional application No. 61/629,938, filed on Dec. 1, 2011.

(51) Int. Cl.
*E05C 19/18* (2006.01)
*B65D 45/32* (2006.01)

(52) U.S. Cl.
CPC ..... *E05C 19/184* (2013.01)

(58) Field of Classification Search
USPC ..... 292/251, 256.71, 288, 289, 291; 49/380, 394
See application file for complete search history.

(56) References Cited

U.S. PATENT DOCUMENTS 1,382,758 A * 6/1921 Brown ..... 292/251
3,593,458 A * 7/1971 Wahlfeld et al. ..... 49/240
3,773,370 A * 11/1973 Jerila ..... 292/169.21
4,206,132 A * 6/1980 Sievers ..... 534/15
4,254,647 A * 3/1981 Finck, Jr. ..... 70/77
4,262,503 A * 4/1981 Kuebler ..... 70/101
4,472,143 A * 9/1984 Bennett et al. ..... 294/34
4,483,101 A * 11/1984 Berzina ..... 49/380
4,955,648 A * 9/1990 Miller ..... 292/258
5,159,782 A * 11/1992 Sales ..... 49/380
5,209,017 A * 5/1993 Ridge ..... 49/380
5,291,760 A * 3/1994 Schrader ..... 70/14
5,722,203 A * 3/1998 Staples et al. ..... 49/380
5,873,273 A * 2/1999 Vick ..... 70/101
6,393,878 B1 * 5/2002 Fayngersh et al. ..... 70/107
6,481,250 B1 * 11/2002 Kuo ..... 70/49
6,502,435 B2 * 1/2003 Watts et al. ..... 70/95
6,502,436 B2 * 1/2003 Beatty ..... 70/134
6,688,063 B1 * 2/2004 Lee et al. ..... 52/455
6,874,827 B1 * 4/2005 Dodson ..... 292/175
6,923,028 B2 * 8/2005 Caldwell et al. ..... 70/56
7,118,143 B2 * 10/2006 L'Heureux et al. ..... 292/175
7,121,045 B2 * 10/2006 Massey et al. ..... 49/380
7,290,415 B2 * 11/2007 Rosenberg et al. ..... 70/9
7,836,736 B2 * 11/2010 Humphris ..... 70/101
8,052,178 B2 * 11/2011 MacDonald et al. ..... 292/145
8,061,165 B1 * 11/2011 Cassini ..... 70/99
8,245,448 B2 * 8/2012 Crane et al. ..... 49/380
8,469,410 B2 * 6/2013 Wood ..... 292/288

(Continued)

*Primary Examiner* — Carlos Lugo

(57) ABSTRACT

A high security adjustable keyless locking contrivance for preventing the forced opening of a hinged door of unoccupied homes or buildings. An engaging apparatus that incorporates a first armor structural plate combined with a first structural cylinder having a pair of first slots and a connecting bolt shaft, which first structural cylinder inserts into a conventional door knob bore hole with the bolt shaft passing through the existing door latch assembly in concert. A second armor structural plate combined with a second structural cylinder that matingly connects to said first structural cylinder from the opposite side of the hinged door, allowing the penetration of the connecting bolt shaft through the second armor structural plate bolt hole which will conjoin the two devices with a security fastener, thus sandwiching and securing the hinged door and door jamb between the two armor structural plates.

2 Claims, 7 Drawing Sheets

(56) References Cited

U.S. PATENT DOCUMENTS

2002/0067046 A1* 6/2002 Cox, Sr. ..... 292/289
2009/0091142 A1* 4/2009 Wilson ..... 292/137
2009/0140530 A1* 6/2009 LePage ..... 292/38
2014/0306461 A1* 10/2014 Luizzi et al. ..... 292/163

* cited by examiner

SECURITY DOOR LOCK DEVICE

RELATED APPLICATION

This patent application claims priority from U.S. Provisional Patent Application Ser. No. 61/629,938, filed Dec. 1, 2011.

REFERENCES CITED

| U.S. Patent Documents | | |
|---|---|---|
| 6,393,878 | March 2002 | Fayngersh, et al. |
| 7,290,415 | November 2007 | Rosenbert, et al. |
| 4,206,132 | May 1977 | Best |
| 4,254,647 | March 1981 | Finck, Jr. |
| 8,061,165 | November 2011 | Cassini |
| 6,688,063 | February 2004 | Lee, et al. |
| 6,502,435 | January 2003 | Watts, et al. |
| 4,472,143 | September 1984 | Bennett, et al. |
| 7,836,736 | November 2010 | Humphris |
| 6,923,028 | August 2005 | Caldwell, et al. |
| 6,481,250 | November 2002 | Calle, et al. |
| 5,873,273 | February 1999 | Vick |
| 5,291,760 | March 1984 | Schrader |
| 4,262,503 | April 1981 | Kuebler |

FIELD OF INVENTION

The present invention relates in general to an adjustable keyless security lock engaging apparatus for use in securing hinged doors from forced entry of unoccupied homes and buildings. The present invention is an improvement over known locking devices in that this apparatus prevents hinged doors from being forced or pried open.

BACKGROUND OF THE INVENTION

Professional contractors have concocted numerous locking systems; however intruders have consistently and successfully overcome all of these systems. For example, the security of a conventional keyed lock and deadbolt is compromised by a forceful prying in the small space between the hinged door and door jamb. Additionally, as reported by the FBI; "84% of the break-ins are due to door jamb failure". Every lock on the market is only as strong as the door jamb that secures it. With the present invention, the hinged door and door jamb are sandwiched between two armor structural plates that makes it impregnable with conventional hand tools.

More importantly, the present invention prevents these break-ins by the installation of two armored plates, which are secured around the hinged door and the door jamb at the latch mechanism. The exterior part of the armored structural plate completely covers the small space between the hinged door and the door jamb, which is where the latch mechanism is located. This prevents the insertion of a crowbar or other device to force open the hinged door. Another problem with the current keyed lock is that a strong force against the door knob itself will result in failure of the door knob and lock. Door knobs are not designed for forceful trauma. Whereas, the present invention is a flat armor structural plate with no protrusions for any outside forces to be applied.

SUMMARY OF THE INVENTION

A principle object of the present invention is to provide an improved high security keyless adjustable device for securing the hinged doors in unoccupied, manufactured and site built homes and from forceful entry.

The present invention allows for simple installation of the security lock device into an existing conventional door knob bore hole and existing door latch assembly, thus sandwiching the door and jamb between two structural armor plates. The design allows for an easy and efficient installation by simply removing the two screws from the inside face of an existing, conventional door knob and removing the existing door knob lock assembly but leaving the existing latch mechanism in place. Then from the OUTSIDE of the home, insert the first armor structural plate apparatus into the existing door knob bore hole and around the existing door latch mechanism. Then from the INSIDE of the home, insert the second armor structural plate apparatus into the door knob bore hole to matingly connect with the first armor structural plate and with a connecting bolt penetrating the second armor structural plate and both devices are conjoined with a security fastener.

By locking the two apparatuses together, the hinged door and the door jamb are sandwiched between the two armor structural plates preventing the exposure of the small space between the hinged door and the door jamb where the latch mechanism is located. This provides maximum security from all forced entry.

BRIEF DESCRIPTION OF THE DRAWINGS

The present invention will be better understood with reference to the appended drawing sheets, wherein.

DETAILED DESCRIPTION

The present invention relates to a High Security Keyless Adjustable Door Lock that prevents the forced opening of all hinged doors of unoccupied homes or buildings. More particularly, the security lock is a two piece apparatus comprising a first configured armor structural plate and a second armor structural plate that are conjoined by a connecting bolt and a security fastener.

PRIOR to the installation on the present invention, the existing door lock has to be removed by simply taking out the two screws from the inside face of the existing door lock and pulling them apart but leaving the door latch mechanism in place.

Figure 1:
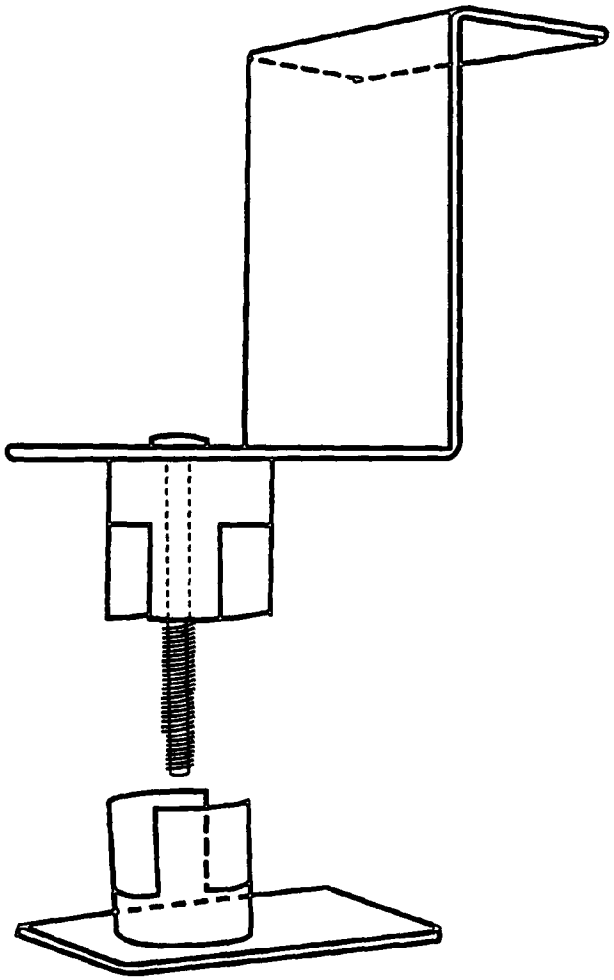
FIG. 1 is a SIDE VIEW of the two components comprising the high security keyless lock apparatus of the present invention in the UNSECURED position.
Figure 2:
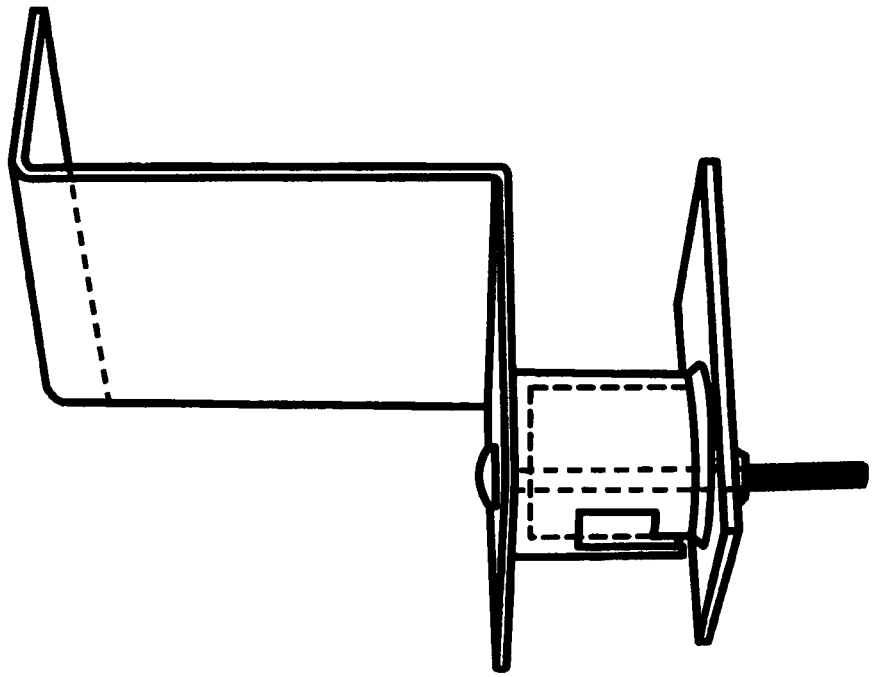
FIG. 2 is a SIDE VIEW of the two components comprising the high security keyless lock apparatus of the present invention in the SECURED position.
Figure 3:
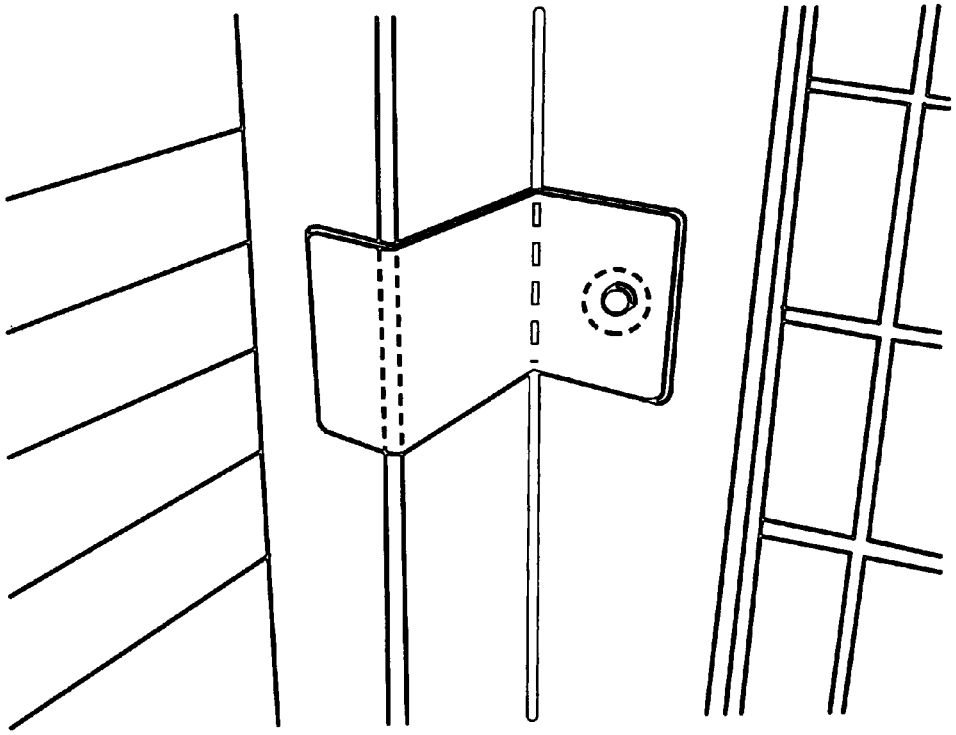
FIG. 3 is an OUTSIDE VIEW of the first armor structural plate of the present invention in the SECURED position protecting the door and door jamb of a hinged rear door at the latch mechanism.

A perspective of the present invention secured in place protecting the hinged door and door jamb at the latch mechanism is:

For an OUTSIDE view refer to FIG. 3.

Figure 4:
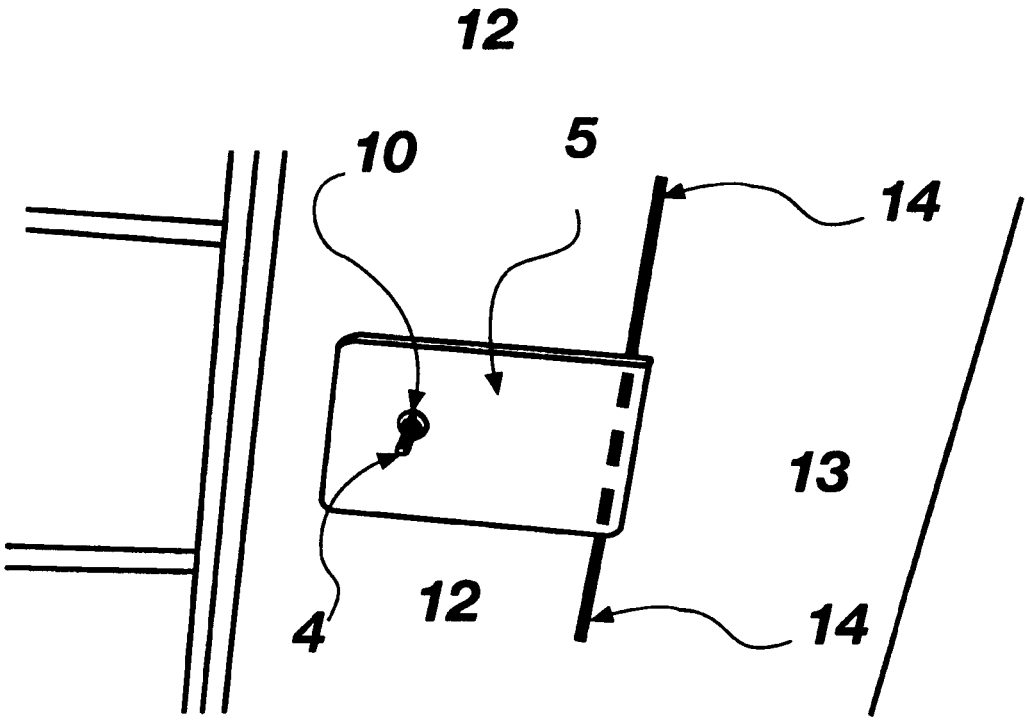
FIG. 4 is an INSIDE VIEW of the second armor structural plate of the present invention in the SECURED position sandwiching the hinged door and door jamb and locked with a security fastener.
Figure 5:
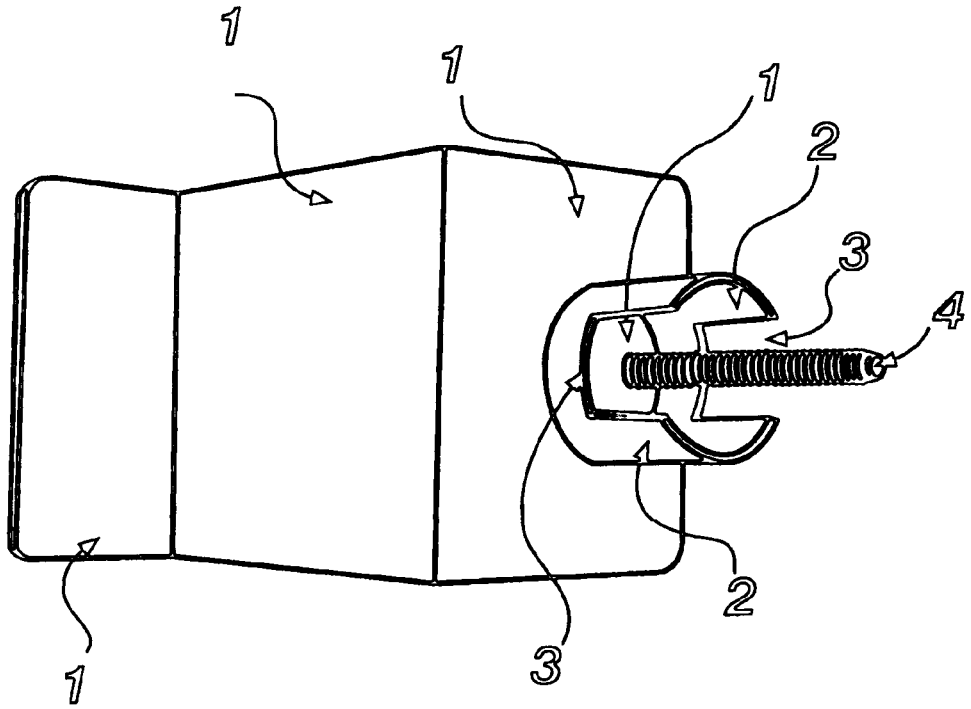
FIG. 5 is an INSIDE VIEW of the first armor structural apparatus illustrating the cylinder, slots and connecting bolt.

For an INSIDE view refer to FIG. 4.

Referring to FIG. 3, OUTSIDE view of the first armor structural plate 1, FIG. 3 is configured to snugly fit all exterior hinged door jambs 13, FIG. 3, while covering the door/jamb crack 14, FIG. 3, at the latch mechanism and secured through the rear door knob bore hole 11, FIG. 3, with a connecting bolt 4, FIG. 3.

An INSIDE view FIG. 4 shows the second armor structural plate 5, FIG. 4, securing the rear hinged door 12, FIG. 4 and door jamb 13, FIG. 4 with a security fastener 10, FIG. 4, thus sandwiching the hinged door and the door jamb between two armor structural plates.

Detailing both components of the High Security Keyless Adjustable Door Lock is as follows:

The first component of the present invention is a configured armor structural plate 1, FIG. E combined with a structural cylinder 2, FIG. E with two slots 3, FIG. E for inserting into the existing door knob bore hole 11, FIG. G from the OUTSIDE and said slots 3, FIG. E fit snugly around the existing door latch mechanism 9, FIG. G to keep both apparatuses from rotating.

Also, incorporated into the first armor structural plate 1, FIG. E is a connecting bolt 4, FIG. E that secures the first armor structural plate 1, FIG. E to the second structural plate 5, FIG. F with a security fastener 10, FIG. D.

Figure 6:
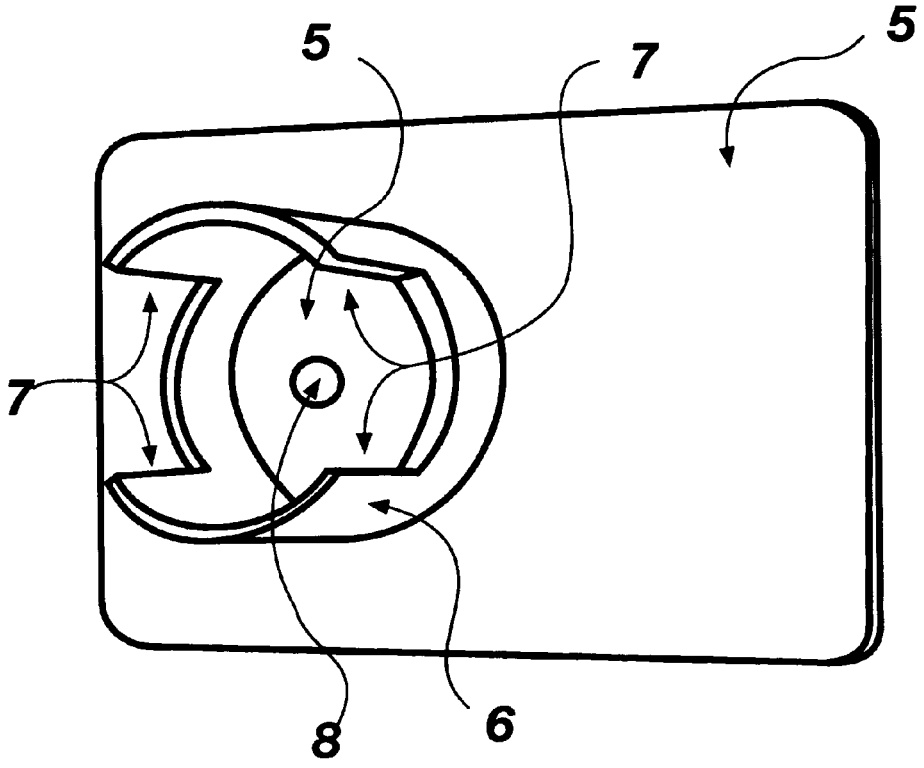
FIG. 6 is an INSIDE VIEW of the second armor structural plate illustrating the cylinder, slots and bolt hole for the insertion of the connecting bolt.
Figure 7:
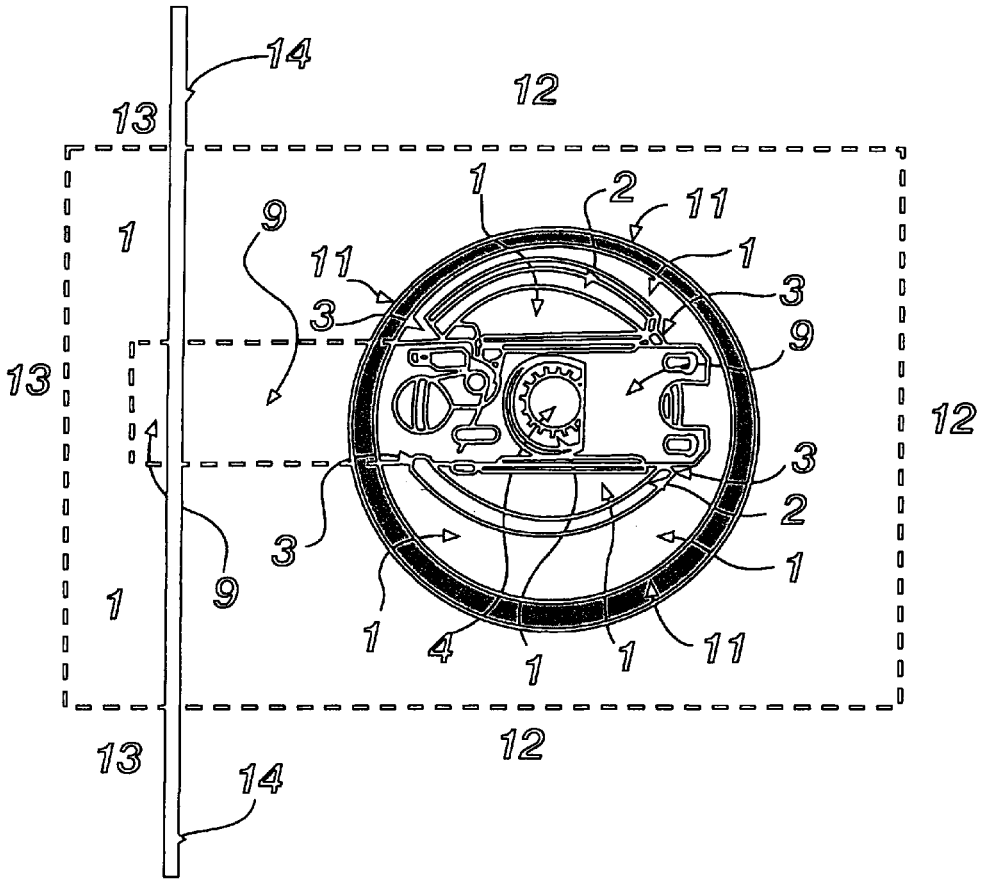
FIG. 7 is an INSIDE VIEW of the first structural cylinder penetrating an existing door knob bore hole from the OUTSIDE and in concert the connecting bolt penetrates the existing door latch mechanism.

The second component of the present invention FIG. 6 is a second armor structural plate 5, FIG. 6 combined with a small structural cylinder 6, FIG. 6 incorporating two slots 7, FIG. 6 and a predetermined bolt hole 8, FIG. 6. This configuration allows for the second structural cylinder 6, FIG. 6 to slide inside the first structural cylinder 2, FIG. 7 and around the existing door latch mechanism 9, FIG. 7 and in concert the connecting bolt 4, FIG. 7 penetrates the predetermined bolt hole 8, FIG. 7 to allow for the locking of the two apparatuses together with a security fastener 10, FIG. 4, thus sandwiching the hinged door 12, FIG. 4/12, FIG. 3, the outside door jamb 13, FIG. 3 the inside door jamb 13, FIG. 4 and the door/jamb crack 14, FIG. 3 between two armor structural plates.

Having described this invention in detail, those skilled in the art will appreciate that modifications may be made of this invention without departing from its spirit. Therefore, it is not intended that the scope of this invention be limited to specific embodiment illustrated and described. Rather, it is intended that the scope of this invention be determined by the appended claims and their equivalents.

I claim:

1. An adjustable security lock for use on door knob bore hole and door latch mechanism located on a door and a door frame, comprising:

a first structural plate having a shape that is configured to fit against the door and door frame, the first structural plate having a first structural cylinder having a pair of first slots, with a connecting bolt fixedly connected to the first structural plate and protruding through an open end of the first structural cylinder;

a second structural plate having a second structural cylinder having a pair of second slots;

wherein the first structural plate is positioned on an outside surface of the door and door frame and having the first structural cylinder and connecting bolt passing through the door knob bore hole and the pair of first slots snugly fitting to the door latch mechanism;

the second structural plate is positioned on an inside surface of the door and having the second structural cylinder passing through the door knob bore hole and the pair of second slots snugly fitting to the door latch mechanism, the second structural plate being attached to the first structural plate by the connecting bolt and a fastener.

2. An adjustable security lock for use on door knob bore hole and door latch mechanism located on a door and a door frame, comprising:

a first structural plate having a shape that is configured to fit against the door and door frame, the first structural plate having a first structural cylinder having a pair of first slots, with a connecting bolt fixedly connected to the first structural plate and protruding through an open end of the first structural cylinder;

a second structural plate configured to matingly connect to the first structural cylinder and the connecting bolt;

wherein the first structural plate is positioned on an outside surface of the door and door frame and having the first structural cylinder and connecting bolt passing through the door knob bore hole and the pair of first slots snugly fitting to the door latch mechanism;

the second structural plate is positioned on an inside surface of the door, and the second structural plate being attached to the first structural plate by the connecting bolt and a fastener.

* * * * *